United States Patent [19]

Bernard et al.

[11] Patent Number: 4,832,822

[45] Date of Patent: May 23, 1989

[54] STEAM CRACKING OF HYDROCARBONS

[75] Inventors: Philippe Bernard, Paris; Francois Prudhon, Versailles, both of France

[73] Assignee: Rhone-Poulenc Chimie de Base, Courbevoie, France

[21] Appl. No.: 204,989

[22] Filed: Jun. 10, 1988

Related U.S. Application Data

[63] Continuation of Ser. No. 917,238, Oct. 7, 1986, abandoned, which is a continuation of Ser. No. 612,542, May 21, 1984, abandoned.

[30] Foreign Application Priority Data

May 20, 1983 [FR] France ..... 83 08395

[51] Int. Cl.[4] ..... C10G 9/36

[52] U.S. Cl. ..... 208/130; 208/106; 208/129; 585/652; 585/539; 585/540; 585/541

[58] Field of Search ..... 208/106, 130, 129; 585/652, 539, 540, 541

[56] References Cited

U.S. PATENT DOCUMENTS

| | | | |
|---|---|---|---|
| 2,941,021 | 6/1960 | Krause et al. | 585/539 |
| 3,005,857 | 10/1961 | Steinhofer et al. | 585/652 |
| 3,019,271 | 1/1962 | Braconier et al. | 585/652 |
| 3,168,592 | 2/1965 | Cichelli | 585/539 |
| 3,203,769 | 8/1965 | Sogawa et al. | 585/539 |
| 3,270,077 | 8/1966 | Tsutsumi et al. | 585/652 |
| 3,399,245 | 8/1968 | Knapp | 585/652 |
| 3,419,632 | 12/1968 | Sogawa et al. | 585/539 |
| 3,563,709 | 2/1971 | Staud et al. | 585/539 |
| 3,692,862 | 9/1972 | Staud et al. | 585/539 |
| 4,136,015 | 1/1979 | Kamm et al. | 208/130 |
| 4,256,565 | 3/1981 | Friedman et al. | 208/130 |

*Primary Examiner*—H. M. S. Sneed
*Assistant Examiner*—Chung K. Pak
*Attorney, Agent, or Firm*—Burns, Doane, Swecker & Mathis

[57] ABSTRACT

The steam and thermal cracking of hydrocarbons is facilely carried out by in situ generating a stream of hot combustion gases including steam, advantageously in the configuration of a downstream axially extending, axially symmetrical helical flowstream, by combustion of steam-producing reactants in a combustion first reaction zone, and serially directly contacting and intimately admixing a liquid hydrocarbon feedstock with said gas of combustion in a downstream isodistribution, non-multi-tubular second reaction zone, advantageously first at a zone of reduced pressure thereof, the momentum of said gas of combustion at the point of direct contact being such as to provide all of the thermal and mechanical energy and heat transfer required to autogenously vaporize, entrain and effect cracking therein of said liquid hydrocarbon feedstock.

15 Claims, 1 Drawing Sheet

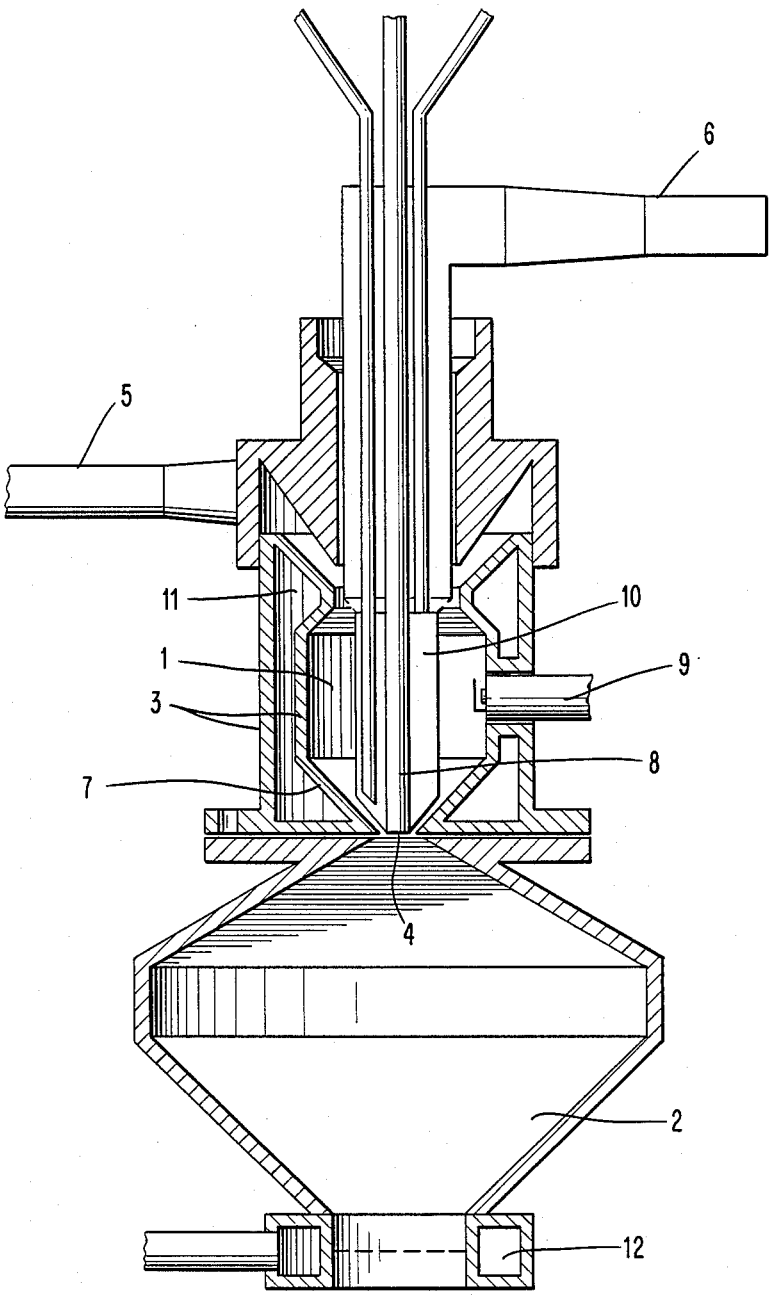
6
5
11
10
1
9
3
8
7
4
2
12

STEAM CRACKING OF HYDROCARBONS

This application is a continuation of application Ser. No. 917,238, filed Oct. 7, 1986, abandoned, which is a continuation of application Ser. No. 612,542, filed May 21, 1984, abandoned.

BACKGROUND OF THE INVENTION

1. Field of the Invention:

The present invention relates to the steam cracking of hydrocarbons, optionally in the presence of hydrogen.

2. Description of the Prior Art:

It is known to this art that the steam cracking of hydrocarbons, or cracking in the presence of steam, was used in the United States between 1930 and 1940 for the production of ethylene and aromatic hydrocarbons.

That process was one in which the charge or feedstock to be cracked, in a dilute state, was circulated within tubes which were externally heated. Technological advances made it possible to increase production capacities and to use increasingly heavy hydrocarbon feedstocks.

It too is known that, in such a process, the steam performs a number of functions. Thus, according to B. Blouri (Etat des connaissances sur le traitement thermique des produits lourds ["State of knowledge regarding the thermal treatment of heavy products"]- *Revue de l'Institut Francais du Petrole,* volume 36, No. 1, January-February 1981), the introduction of steam has three main functions to perform:

(1) It reduces the partial pressure of the hydrocarbon and thus promotes selective cracking in respect of olefins;

(2) it reduces the partial pressure of the high molecular weight aromatic hydrocarbons and reduces their tendency to form coke with the cracking charge and to deposit heavy residues on the face surfaces of the exchangers and the conduits; and (3) It has a sufficient oxidizing effect on the metal pipes to give a significant reduction in the catalytic effects of the iron or nickel, for the formation of carbon.

A different process is also known to this art, the goal of which is to replace the steam with hydrogen under pressure. The focus of such process is to produce a large proportion of alkenes by cracking a charge without use of a catalyst, in a very short residence time and at a temperature which, if the charge is naphtha, is on the order of 930° C.

The use of hydrogen provides two advantages: the conversion of heavy products into light products is improved, and there is a reduced formation of deposits.

Unfortunately, the presence of a large amount of hydrogen gives rise to hydrogenation reactions which take place in competition with the cracking reactions in a strict sense. The formation of alkenes then suffers from such an inhibitory effect.

Finally, irrespective of the situation, the parasitic effects of exposed wall members, e.g. encrustation, different reaction kinetics with production of varying reaction products, etc., are a constraint in steam cracking processes.

Generally, an effort is made to avoid using multitubular reactors. It has long been proposed that cracking should be carried out by direct contact with combustion gases, for example, by means of thermal shock as in U.S. Pat. No. 2,790,838. More elaborate means of contact have also been proposed. Thus, U.S. Pat. No. 4,136,015 provides for introducing the feedstock in atomized form into the gaseous stream produced by combustion of the heavy fuel in the presence of an oxidant, in a burner and mixing zone, followed by a cracking reaction zone and a quenching zone.

The reactor is in the configuration of a convergent-divergent nozzle.

However, use of such a reactor assumes that a complex pattern of flow of fluids can be controlled, as pointed out by Barendregt, *Information Chimie,* No. 231, pages 217–221 (November, 1982), i.e.:

"The fundamental condition for any cracking process with the production of olefins is suitable control in respect of the residence time/temperature ratio, that control effect being possible in a tubular reactor. As recent developments are in the direction of very short residence times, it will be more difficult to create that fundamental condition and the development of new technologies will be found to be an essential factor."

However, the immediately aforesaid implies that the mixture between a viscous liquid, at the beginning, and a gaseous phase, is homogenously produced over a period of time which is substantially less than the residence time, namely, that the spraying, vaporization and mixing time is of minimum duration.

Also to be added to such disadvantages and drawbacks are those raised by the necessity for changes in feedstock, insofar as the process involves using charges ranging from the lightest to the heaviest and insofar as the process is to be controlled in dependence on the final product which is to be the principal product of the process, e.g., whether ethylene or some other product.

Thus, in spite of the repeated efforts and the many solutions proposed over a period of some fifty years, the basic problems involved in steam cracking have still not been satisfactorily solved.

SUMMARY OF THE INVENTION

Accordingly, a major object of the present invention is the provision of an improved process for the thermal cracking of hydrocarbons which is conspicuously devoid of these disadvantages and drawbacks to date plaguing the state of this art, which improved process is of direct-contact type and does not require use of a multi-tubular reactor.

Briefly, consistent herewith the combustion gas is formed in situ and contains steam. In addition, it serves to provide the mechanical energy required to produce in situ the transfer surface as well as the thermal energy required for the cracking operation; therefore heat exchange is effected without the disadvantage of a tubular heat exchange surface, and the combustion gas and the feedstock are subject to intensive admixing.

BRIEF DESCRIPTION OF THE DRAWING

The FIG. of Drawing is an axial, diagrammatical cross-sectional view of apparatus suitable for carrying out the process according to the invention.

DETAILED DESCRIPTION OF THE INVENTION

More particularly according to the present invention, in carrying out the subject process, the gaseous reactants are introduced into a first reaction zone 1 in such fashion that the resulting gaseous phase is in the form of a symmetrical helical stream, said reactants interreacting in said first zone to produce a gas containing superheated steam which is discharged in the configuration of an axially symmetrical helically spinning flowstream into an isodistribution reaction zone 2. The hydrocarbon feedstock to be cracked is introduced into said reaction zone 2 at the level within said zone which is in a condition of relative depression (reduced pressure), established by means of the axial spinning flowstream configuration, the momentum of the combustion gas which contains the superheated steam being sufficient with respect to that of the liquid feedstock to cause said liquid feedstock to be disintegrated and atomized and each droplet formed to be entrained within an associated unit of gaseous volume, the amount of heat supplied by the combustion gas being sufficient to permit vaporization of said feedstock, superheating and cracking thereof at the desired temperature.

In practice, the momentum of the units of volume of the gaseous phase emanating from the reaction zone 1 is at least 100 times, and preferably from 1000 times to 10,000 times, greater than that of the associated units of volume of the liquid phase.

In contrast to that which occurs in conventional processes for atomization, with randodm distribution of the units of volume of the liquid phase, the heat transfer is effected over a very short period of time in an isodistribution (wherein each droplet of material in any given cross-sectional plane through the advancing flowstream is chemically, physically and hydrodynamically isotropic), by virtue of the quality of contact between the two phases (such effect being referred to as "isoflash").

In that case, it is necessary only to use pressures of the gases which are low in relation to the pressure in the contact region.

The rate at which the liquid feedstream is introduced, which liquid may optionally be pre-dispersed, is generally low, typically lower than 10 m/s and preferably lower than 5 m/s.

In accordance with the process of the invention, the helically spinning gaseous phase is produced in situ by means of gases which serve to generate the combustion gas containing the steam used for the steam cracking process.

The temperature of the combustion gas will depend in particular on the nature of the feedstock to be cracked and the final products which are sought to be produced as the principal products of the process, but in any event it must be sufficient to effect cracking of the feedstock, in all cases being greater than the cracking temperatures used in multi-tubular reactors, which are on the order of 800° to 900° C.

The temperature of the stream of helically spinning gases will, therefore, advantageously be as high as possible, taking account of the capabilities of the equipment, namely, in practice from 1000° to 2500° C.

The combustion gas containing superheated steam may be produced by combustion of a hydrocarbon.

The superheated steam which is produced in the reaction zone 1 may also be obtained by direct combustion of hydrogen and oxygen, at least one of such reactants being introduced into said reaction zone 1 as a symmetrical helical flow.

It is also possible to introduce excess amounts of hydrogen. The hydrogen may perform a number of functions, such as thermal diluent in the reaction zone 1, and also as a chemical participant in the cracking operation, in the reaction zone 2. It is also possible to use a source of oxygen which is not pure.

Optionally, a source of oxygen may be introduced in very low amounts into the contact and isodistribution reaction zone 2.

Surprisingly, it has been found that the superheated steam which is produced immediately upstream of the isodistribution reaction zone, wherein the cracking operation is carried out (at least in part), provides an alternative to the disadvantages associated with the prior art.

Although the theory or mechanism of action of the steam under the conditions of the invention is not presently completely understood, it is thought that the physico-chemical state in which the steam occurs is not an unimportant factor.

As stated above, the process according to the invention permits of a high degree of flexibility, with regard to the feedstock introduced.

It is advantageously carried out in an apparatus comprising:

(i) An upstream reaction zone 1 in which the combustion required for producing the superheated steam takes place;

(ii) A downstream reaction zone 2 in which the cracking reaction takes place;

(iii) Tangential inlet means for injection and symmetrical distribution of at least one gaseous source of the group comprising hydrogen, hydrocarbons and oxygen;

(iv) A restricted downstream passage, or port of reduced cross-section such as to impart a pattern of an axially symmetrical helically spinning configuration to the downwardly descending stream of gas between said zones 1 and 2;

(v) At least one means for axially introducing the hydrocarbon feedstock into the inlet of the cracking reaction zone; optionally, the feedstock may be predispersed in order to promote the atomization thereof by the helically spinning flow which issues from the combustion reaction zone 1; and (vi) Means for effecting quenching of the products issuing from the overall reaction.

In order to further illustrate the present invention and the advantages thereof, with particular reference to the accompanying Figure of Drawing, the following specific examples are given, it being understood that some are intended only as illustrated and in nowise limitative.

The apparatus illustrated in said accompanying Figure of Drawing, wherein the $H_2$ and $O_2$ serve as the source of the superheated steam, comprises a combustion reaction zone 1 defined by a double-walled casing 3 that terminates at its downstream end in a reduced cross-section exit port 4 of restricted flow passage, a conduit 5 for the tangential inlet feed of hydrogen gas and another conduit 6 for the inlet feed of oxygen gas. The inner wall member of said casing 3 terminates in said reduced cross-section exit port 4 by means of downwardly axially converging wall section 7, with the inlet conduit 8 for introduction of the hydrocarbon feedstock also terminating at said zone 4 of restricted flow passage, essentially at the same height thereof. Said conduit 8 is coaxial within said combustion reaction zone 1, and the contacting reaction zone 2 is immediately axially downstream of said reaction zone 1 and is in communicating relationship therewith. The reaction zone 2 is essentially an extension of the reaction zone 1. Also provided in said combustion reaction zone 1 are firing means 9 (e.g., a sparkplug) and a heat exchange medium or coolant circulates within the annular cooling spaces 10 and 11. The annular cooling space 11 is defined by the double walls of the reaction zone 1 and the annular cooling space 10 is defined by a wall member coaxial with the hydrocarbon feed inlet 8 and is laterally spaced therefrom. Quenching means 12 are provided at the outlet of the contacting reaction zone 2, Cf. U.S. Pats. Nos. 4,124,353, 4,257,339, 4,263,234, 4,265,702, 4,267,131, and 4,350,101 for more detailed description of certain of the process/apparatus parameters hereof.

EXAMPLES

The hydrocarbon feedstock was a liquid hydrocarbon fuel (domestic fuel oil in accordance with French standards, of type 2 in accordance with the ASTM standard).

In the following examples, the temperature/residence time ratio was varied, using an apparatus having an overall height of 20 centimeters.

TABLE I

OPERATING CONDITIONS:

| Examples | Rate of flow of hydrocarbon feedstock / Volume of reaction zone 2 ($m^3$) (T/h) | Temperature in reaction zone 2 (°C.) | Residence time in reaction zone 2 (milliseconds) |
|---|---|---|---|
| 1 | 23.3 | 960 | 5 |
| 2 | 7.1 | 1,100 | 9 |
| 3 | 19 | 850 | 9 |

Examples 1 and 2 were carried out using a reaction zone 2 which was biconical in shape, as illustrated in the Figure of Drawing.

In Example 3, the biconical reaction zone was replaced by a single tubular reaction zone.

TABLE II

RESULTS:

| Yield in % by weight with respect to the feedstock | Example 1 | 2 | 3 |
|---|---|---|---|
| $H_2$ | 0.7 | 2.6 | 3.7 |
| $CH_4$ | 11.4 | 15.3 | 13.5 |
| $C_2H_2$ | 10.0 | 20.4 | 7.3 |
| $C_2H_4$ | 28.3 | 27.3 | 30.4 |
| $C_2H_6$ | 3.1 | 1.7 | 2.2 |
| $C_3H_4$ | 2.0 | 1.5 | 1.3 |
| $C_3H_6$ | 12.9 | 5.6 | 11.4 |
| $C_3H_8$ | 1.7 | | 5.1 |
| $C_4H_2$ | 1.3 | | 0.5 |
| $C_4H_4$ | 2.7 | 2.0 | 1.1 |
| $C_4H_6$ | 2.8 | 2.1 | 3.4 |
| $C_4H_8$ | 4.3 | 2.1 | 4.7 |
| $C_5$ and + | 15.0 | 12.1 | 13.2 |
| C in the form CO—$CO_2$ | 2.9 | 5.5 | 2.8 |

It will be seen from the Examples 1–3. that the rate of conversion of the feedstock into fractions with less than 5 carbon atoms is higher than 80%, that is to say, it is excellent, as good as for a lighter naphtha by conventional proceeds (multi-tubular reactor), which corresponds to a better level of performance; that the yield in respect of $C_2H_2+C_2H_4+C_3H_6$ is good, on the order of 50%; that it is possible to simply vary the selectivity, in particular in respect of acetylene; and that these results are obtained with an apparatus of small size, having regard to the size of the reaction chamber.

A determination was made on a heavy hydrocarbon (heavy fuel oil in accordance with French standards, of type 6 in accordance with the ASTM standard), to ascertain that the mixture formed by the following light hydrocarbons ($CH_4$ - $C_2H_2$ - $C_2H_4$ - $C_3H_6$), under the same conditions as in Example 3, was of a similar composition to that produced from the above-described light hydrocarbon, as shown in the following Table III.

TABLE III

MOLAR COMPOSITION OF THE MIXTURE ($CH_4 + C_2H_4 + C_2H_2 + C_3H_6$):

| TYPE OF FUEL | LIGHT | | | | HEAVY | |
|---|---|---|---|---|---|---|
| Test | 4 | 5 | 6 | 7 | 8 | 9 |
| Temperature (°C.) | 900 | 910 | 920 | 930 | 930 | 1010 |
| % $CH_4$ | 21.3 | 20.6 | 23.6 | 21.8 | 23.9 | 25.1 |
| % $C_2H_4$ | 49.3 | 50.7 | 52.7 | 51.8 | 53.1 | 44.5 |
| % $C_2H_2$ | 10.8 | 10.9 | 10.1 | 12.4 | 11.4 | 25.5 |
| % $C_3H_6$ | 18.6 | 17.9 | 13.6 | 13.9 | 11.6 | 4.9 |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A process for the steam and thermal cracking of liquid hydrocarbons, comprising generating in situ a stream of hot combustion gases including steam as a downstream axially symmetrical helical flow stream by combustion of steam-producing reactants in a combustion first reaction zone, providing a cooling chamber surrounding the combustion first reaction zone, and serially directly contacting and intimately admixing said liquid hydrocarbons with said hot combustion gases in a downstream isodistribution, non-multi-tubular second reaction zone, injecting said liquid hydrocarbons from a source through a conduit axially into said second reaction zone at a depression zone within said second zone, said depression zone comprising an outlet of the conduit, said depression zone defining a condition of reduced pressure established by the flow stream configuration, the momentum and heat of said hot combustion gases in the depression zone being sufficient to provide all of the thermal and mechanical energy and heat transfer required to autogeniously vaporize, entrain and effect cracking therein of said liquid hydrocarbons.

2. The process as defined by claim 1, said hot combustion gases further comprising superheated steam.

3. The process as defined by claim 1, said depression zone comprising an outlet of restricted flow passage.

4. The process as defined by claim 1, the momentum of the units of volume of said hot combustion gases being at least 100 times greater than the momentum of the units of volume of said liquid hydrocarbons at said depression zone.

5. The process as defined by claim 4, the momentum of said hot combustion gases ranging from 1000 to 10,000 times greater than the momentum of said liquid hydrocarbons at said depression zone.

6. The process as defined by claim 1, the temperature of said hot combustion gases being greater than 800° C.

7. The process as defined by claim 1, the temperature of said hot combustion gases ranging from 1000° to 2500° C.

8. The process as defined by claim 1, said hot combustion gases being generated by combustion of steam-producing reactants comprising a hydrocarbon.

9. The process as defined by claim 1, said hot combustion gases being generated by combustion of steam-producing reactants comprising hydrogen and oxygen.

10. The process as defined by claim 1, said steam-producing reactants comprising a stoichiometric excess of hydrogen.

11. The process as defined by claim 1, further comprising introducing a minor amount of oxygen into said isodistribution second reaction zone.

12. The process as defined by claim 4, said liquid hydrocarbons being introduced at a rate of less than 10 m/s.

13. The process as defined by claim 1, said helical flowstream being generated by introducing at least one of said steam-producing reactants into said first reaction zone through tangential inlet means and passing the resulting hot combustion gases through a restricted downstream passage to impart a pattern of an axially symmetrical helically spinning configuration to said stream of hot combustion gases between said first reaction zone and said second reaction zone.

14. The process as defined by claim 13, said steam-producing reactants comprising at least one of a hydrocarboon, hydrogen and oxygen.

15. The process as defined by claim 3, said outlet of restricted flow passage being located between said first reaction zone and said second reaction zone.

* * * * *